United States Patent [19]

Endo

[11] Patent Number: 5,035,654

[45] Date of Patent: Jul. 30, 1991

[54] ELECTRICAL CONNECTOR WITH SOCKET CONTACTS OF DIFFERENT SIZES HAVING MEANS FOR PREVENTING ERRONEOUS CONNECTION

[75] Inventor: Hiroshi Endo, Tokyo, Japan

[73] Assignee: Japan Aviation Electronics Industry Limited, Japan

[21] Appl. No.: 489,704

[22] Filed: Mar. 7, 1990

[30] Foreign Application Priority Data

Mar. 8, 1989 [JP] Japan ..... 1-25507[U]

[51] Int. Cl.[5] ..... H01R 13/00

[52] U.S. Cl. ..... 439/679

[58] Field of Search ..... 439/660, 677, 679

[56] References Cited

U.S. PATENT DOCUMENTS 4,232,930 11/1980 Teti ..... 439/679

FOREIGN PATENT DOCUMENTS 357517 8/1922 Fed. Rep. of Germany ..... 439/679

*Primary Examiner*—Joseph H. McGlynn

*Attorney, Agent, or Firm*—Laff, Whitesel, Conte & Saret

[57] ABSTRACT

An electrical connector comprising a plurality of socket contacts of different cross sectional sizes and an insulator housing a plurality of conduits accommodating the socket contacts. In order to insure accommodation of the socket contacts in the corresponding conduits, each socket contact has one or more lateral projection and the corresponding conduit accompanies a lateral groove for receiving the lateral projection so that the socket contact is inserted in the corresponding conduit with a predetermined attitude. Further, in order to prevent a small sized socket contact from being erroneously inserted in one of conduits for accommodating a large sized socket contact, the lateral projections of the small socket contact are formed so that one of the lateral projections exceeds the lateral groove of the conduit for the large socket contact and cannot be inserted into both of the large conduit and its groove.

3 Claims, 2 Drawing Sheets

ELECTRICAL CONNECTOR WITH SOCKET CONTACTS OF DIFFERENT SIZES HAVING MEANS FOR PREVENTING ERRONEOUS CONNECTION

BACKGROUND OF THE INVENTION (1) Field of the Invention

The present invention relates to an electrical connector having a plurality of socket contacts for receiving a plurality of plug contracts, and in particular, to such an electrical connector having means for preventing erroneous connection.

(2) Description of the Prior Art

A conventional electrical connector of the above-mentioned type for use in connection with wires of a discrete type comprises a plurality of socket contacts having hollow active portions which are different from one another in a cross-sectional size for receiving plug contacts of different cross-sectional sizes. Those socket contacts are fixedly accommodated in corresponding conduits formed in an insulator housing. The conduits in the housing have cross-sectional sizes receivable of the corresponding socket contacts, that is, have cross-sectional sizes slightly larger than those of the active portions of the corresponding socket contacts.

In such conventional electrical connectors, since a large size socket contact, which has the active portion of a large cross-sectional size, cannot be accommodated in a small conduit having a small cross-sectional size, an erroneous connection can be prevented in connection with the large socket contacts. However, since a small size socket contact having the active portion of a small cross-sectional size can be inserted in not only the small conduit but also the large conduit, the erroneous connection cannot necessarily be prevented in connection with the small socket contacts.

SUMMARY OF THE INVENTION

It is, therefore, an object of the present invention to provide an electrical connector comprising a plurality of socket contacts having hollow active portions with different in cross-sectional sizes, from one socket to another, wherein the socket contats can be inserted into correct conduits in an insulator housing without any small socket contact being inserted in any large sized conduit for receiving a large size of socket contact.

The present invention is applicable to an electrical connector comprising a plurality of socket contacts having hollow active portions, at least one of which, is different from another one, in a cross-sectional size for receiving plug contacts of different cross-sectional sizes, a particular one of the socket contacts having a large cross-sectional size of the hollow active portion as a large active portion, a specified one of the socket contacts having a small cross-sectional size of the hollow active portion as a small active portion, and an insulator housing having a plurality of conduits for fixedly accommodating the corresponding ones of the plurality of socket contacts, a particular one of the plurality of conduits accommodating the particular socket contact and having a large size as a large conduit for containing the large active portion, a specified one of the plurality of conduits accommodating the specified socket contact and having a small size as a small conduit for containing the small active portion. According to the present invention, each one of the socket contacts is provided with at least one lateral projection laterally extending therefrom whereby the specified socket contact is provided with the at least one lateral projection as a specified lateral projection for serving as a stopper to prevent the specified socket contact from being accommodated in the large conduit, each of the conduits accompanying at least one groove formed in the insulator housing which groove extends in a lateral direction from each conduit and in a direction along each conduit, the at least one conduit accompanied with each conduit receiving the at least one lateral projection of each socket contact accommodated in each conduit.

DESCRIPTION OF THE PREFERRED EMBODIMENTS

Figure 1:
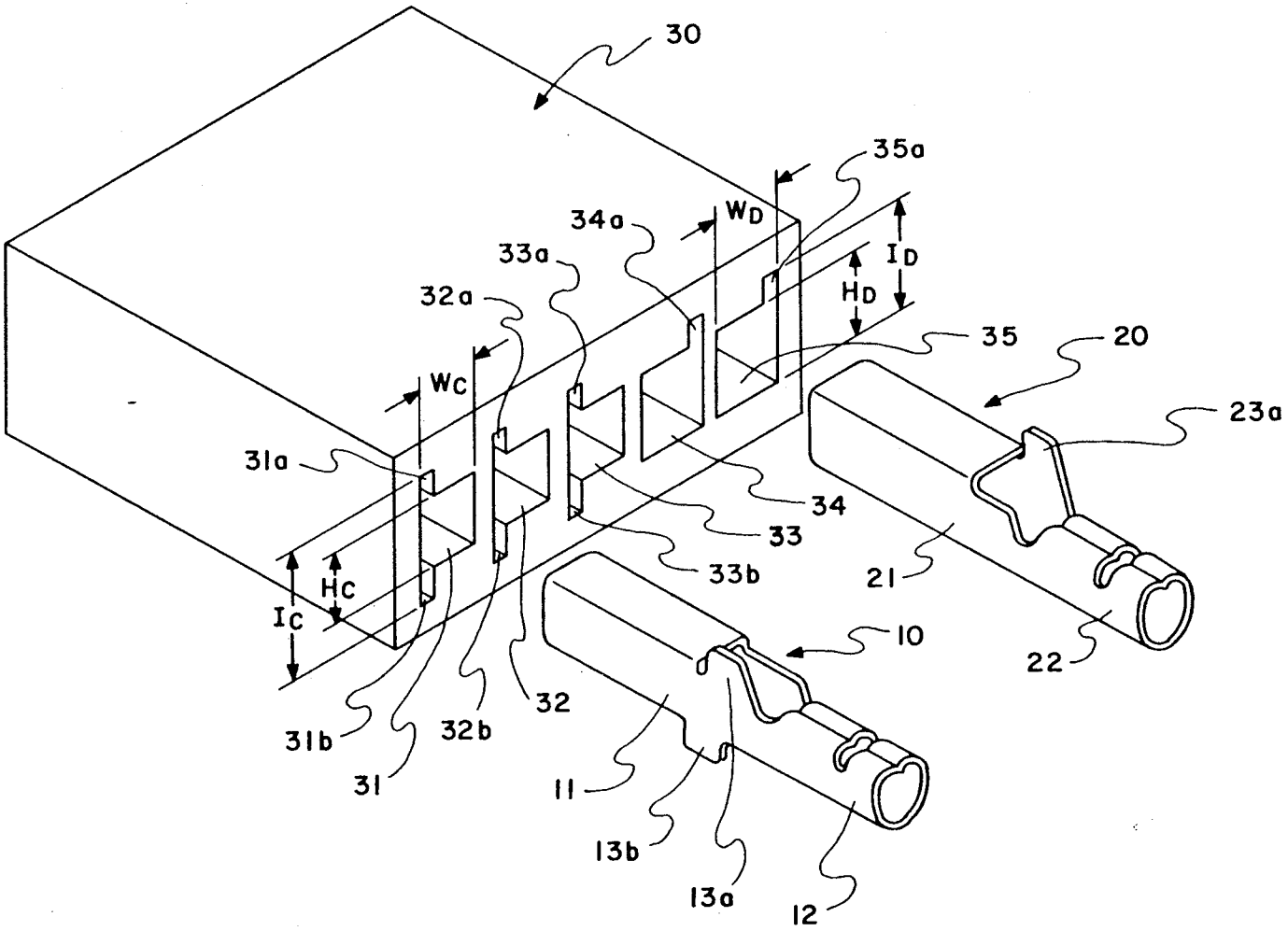
FIG. 1 is a perspective view of an electrical connector according to one embodiment of the present invention with socket contacts being disassembled from an insulator housing.

Referring to FIG. 1, the electrical connector shown therein comprises two types of socket contacts 10 and 20 of different sizes and an insulator housing 30 having conduits 31–35 for receiving the socket contacts 10 and 20 therein. The socket contact 10 of one type has a can-type hollow active portion 11 of a small cross-sectional size. Accordingly, the socket contact 10 is called a small socket contact . On the other hand, the socket contact 20 of the other type has a can-type hollow active portion 21 of a large cross-sectional size. Accordingly, the socket contact 20 is called a large socket contact.

The conduits 31–33 and 34–35 are different in cross-sectional size and are capable of accommodating the socket contacts 10 and 20, respectively.

The term "cross-sectional size" with respect to each of socket contacts 10 and 20 and conduits 31–35 means a sectional size sectioned in a direction perpendicular to a longitudinal direction thereof.

The small socket contact 10 is made by bending a metal plate and it is further provided with a wire-connecting portion 12 to which a wire is connected and a pair of lateral projections **13*a* and 13*b* which laterally extend from a connecting portion between the active portion 11 and the wire-connecting terminal 12. The lateral projections 13*a* and 13*b* extend in a direction perpendicular to the longitudinal direction of the socket contact 10**, that is, in the vertical direction in the figure.

Figure 2:
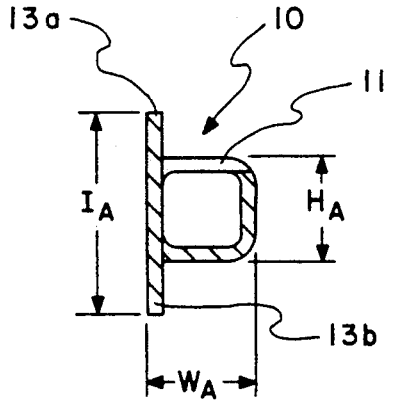
FIG. 2 is a cross-sectional view of a small socket contact of the electrical connector of FIG. 1.

Referring to FIG. 2, the active portion 11 of the small socket contact 10 has a height $H_A$ and a width $W_A$. $I_A$ represents a vertical size or a height of the socket contact 10 including the projections **13*a* and 13*b***

Returning to FIG. 1, the large socket contact 20 is made of the same material as that of the small socket contact 10 and is provided with a wire-connecting terminal 22 and a lateral projection **23*a* which laterally extends from a connecting portion between the active portion 21 and the wire-connecting terminal 22. The lateral projection 23***a* extends in a lateral direction or upward as shown in FIG. 1.

Figure 3:
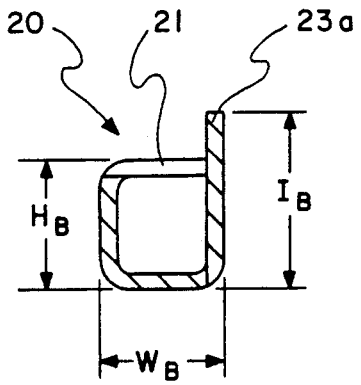
FIG. 3 is a cross-sectional view of a large socket contact of the electrical connector of FIG. 1.

Referring to FIG. 3 illustrating the dimensions of the cross-section of the large socket contact 20, the active portion 21 has a height $H_B$ and a width $W_B$, the height of the large socket contact 20 including the lateral projection 23*a* is $I_B$.

Referring to FIG. 1 again, each of conduits 31–33 in the housing 30 is for receiving the small socket contact 10 and has a cross-sectional size which is slightly larger than the contour of the active portion of the small socket contact 10. Therefore, each of the conduits 31–33 is called a small conduit.

The small conduit 31 is accompanied with two grooves 31*a* and 31*b* for receiving the lateral projections 13*a* and 13*b* of the small socket contact 10. That is, the insulator housing 30 is forming with each of the grooves 31*a* and 31*b* laterally extending from the small conduit 31 and also extends along the small conduit 31. Each of the other small conduits 32 and 33 also has a pair of grooves 32*a*–32*b* and 33*a*–33*b* for receiving the lateral projections 13*a* and 13*b*.

Figure 4:
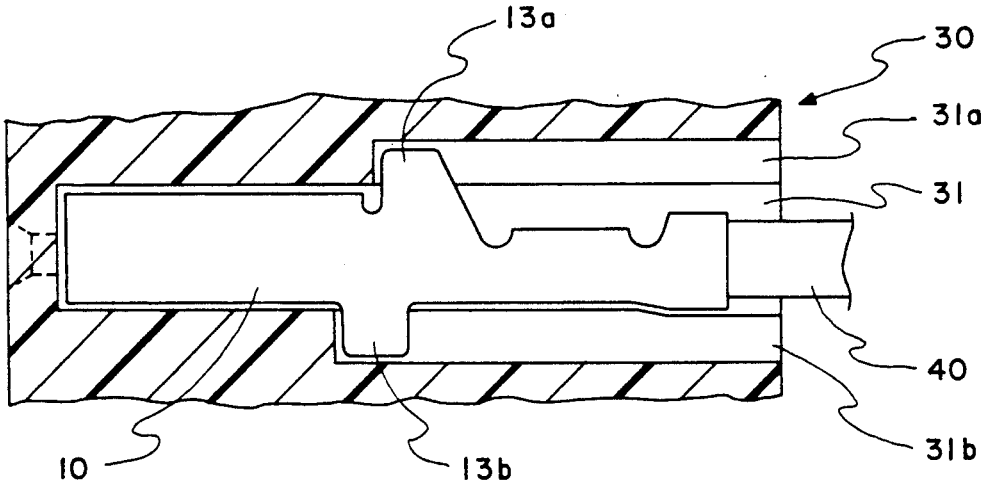
FIG. 4 is a partial cross-sectional view of the connector with the small socket contact of FIG. 2 being accommodated in a corresponding conduit of the housing.

The lateral projections 13*a* and 13*b* of the small socket contact 10 are formed at predetermined angular positions on the small socket contact 10. While, the lateral grooves 31*a* and 31*b* 32*a* and 32*b* and 33*a* and 33*b* are also formed at predetermined angular positions of the small conduit 31–33. Therefore, the small socket contact 10 is inserted into the small conduit 31–33 with a correct orientation, as shown in FIG. 4. In the FIG., 40 represents an insulated wire connected to the wire-connecting portion of the socket contact 10. If the small socket contact 10 is intended to be inserted into the small conduit 31–33 without the correct orientation, the small socket contact 10 cannot be inserted in the small conduit 31–33. Therefore, the lateral projections 13*a* and 13*b* serve as a stopper for preventing the small socket contact 10 to be inserted into the small conduit 31, 32 or 33 with an erroneous orientation.

The large conduit 35 is also accompanied with a groove 35*a* for receiving the lateral projection 23*a* of the large socket contact 20. That is, the insulator housing 30 is formed with the groove 35*a* laterally extending from the large conduit 35 and also extends along the large conduit 35. The other large conduit 34 also has a groove 34*a* for receiving the lateral projection 23*a*.

Figure 5:
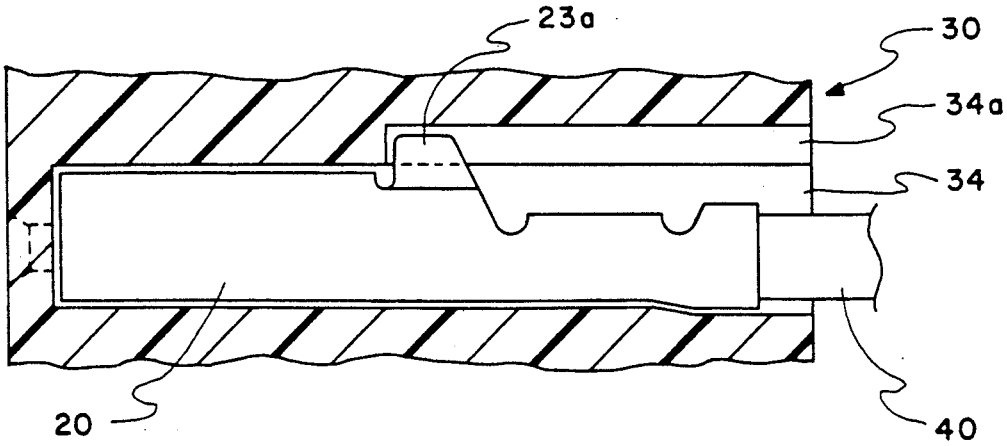
FIG. 5 is a partial cross-sectional view of the connector with the large socket contact of Fig. 3 being accommodated in a corresponding conduit of the housing.

The lateral projection 23*a* of the large socket contact 20 are formed at a predetermined angular position on the large socket contact 20. While, the lateral groove 34*a* and 35*a* are also formed at a predetermined angular positions of the large conduit 34–35. Therefore, the large socket contact 20 is inserted into the large conduit 34–35 with a correct orientation, as shown in FIG. 5. If the large socket contact 20 is intended to be inserted into the large conduit 34–35 without the correct orientation, the large socket contact 20 cannot be inserted in the large conduit 34–35. Therefore, the lateral projection 23*a* serves as a stopper for preventing the large socket contact 20 to inserted into the large conduit 34 or 35 with an erroneous orientation.

The large socket contact 20 cannot be inserted into any one of the small conduits 31–33 because the large active portion 21 has a cross sectional size larger than that of the cross-sectional size of the small conduit 31–33.

On the other hand, the lateral projections 13*a* and 13*b* of the small socket contact 10 are made with sufficient dimensions so that the lateral projections 13*a* and 13*b* bars insertion of the small socket contact into the large conduit 34 or 35 in any orientation or attitude.

In order to prevent the small socket contact 10 from being inserted in the large conduit 34 and 35, the following conditions are met with respect the dimensions of each part of the electrical connector:

| | |
|---|---|
| For socket contacts 10 and 20; | $H_B > H_A$, $W_B > W_A$, $I_A > I_B$ |
| For conduits 31–35; | $H_D > H_C$, $W_D > W_C$, $I_C > I_D$ |
| For socket contacts and conduits; | $H_D > H_B > H_C > H_A$, $W_D > W_B > W_C > W_A$, $I_B > W_D$, $I_B > H_D, > I_A > H_C$, $I_C > I_A > I_D > I_B$. |

$H_D$, $H_C$, $W_D$, $W_C$, $I_C$ and $I_D$ represent dimensions of the small and large conduits 31 and 35, as shown in FIG. 1.

Under the above-described conditions, the small socket contacts 10 cannot be inserted into the large conduits 34 and 35 in any attitude, because one of the lateral projections 13*a* and 13*b* exceeds the groove 35*a* and is inserted in neither conduit 35 nor lateral groove 35*a*.

In the above embodiment, the "erroneous connection" connection with the socket contacts has been treated as such cases: (1) a wrong orientation of the socket contact in the conduit; (2) accommodation of the large socket contact in the small conduit; and (3) accommodation of the small socket contact in the large conduit. A case of the same size connection such as accommodation of the small socket contact 10 in the small conduit 31, 32 or 33 is treated as non-erroneous connection.

However, if small socket contacts having the active portions of the same cross-sectional size are made to have different lateral projections in shape, angular position and/or number, and if the corresponding small conduits are made to have grooves for receiving those lateral projections, each of the small socket contacts, even if they have active portions of the same size, can be inserted only in the corresponding small conduit but not inserted in the other small conduits. For example, one of two small socket contracts 10 is made to have two lateral projections 13*a* and 13*b* while the other small socket contact 10 is made to have a single lateral projection similar to the lateral projection 23*a* in FIG. 1, and if the small conduit 31 has the grooves 31*a* and 31*b* as shown in FIG. 1 while another small conduit 32 has a single groove similar to 35*a* in FIG. 1, the former small socket contact 10 having two lateral projections and the latter small socket contact having a single lateral projection can be inserted in small conduit 31 having two grooves and the other small conduit 32 having one groove, respectively, but the former socket contact having two lateral projections and the latter socket contact having a single lateral projection cannot be inserted in the conduit 32 having a single groove and the other conduit 31 having two grooves, respectively.

In the above-mentioned embodiment, although the present invention has been described in an electrical connector having socket contacts having active portions of two different cross-sectional sizes; it is not limited thereto but is applicable to an electrical connector having socket contacts having active portions of three or more different sizes.

In practice, a securing member is provided for fixing or securing each of the socket contacts 10 and 20 in the corresponding one of the conduits 31–35 in the housing 30 to prevent disengagement of the socket contact with the housing after the socket contact is inserted in the corresponding conduit. However, the securing member is conventionally known and is not related to the present invention, it is not shown in the figures.

The present invention has been described in connection with the embodiment using two types of socket contacts having can-type hollow active portions, the present invention can be applied to electrical connectors using more than two types of socket contacts. The shape of the active portion of the socket contacts is not restricted to the can-type but may be any other shape.

What is claimed is:

1. An electrical connector comprising a plurality of separated and individual socket contacts having hollow active portions, at least two of said socket contacts being different from one another in a cross-sectional size for receiving plug contacts of different cross-sectional sizes, a particular one of said socket contacts having a large cross-sectional size of said hollow active portion , a specified one of said socket contacts having a small cross-section size of said hollow active portion , and an insulator housing having a plurality of conduits fixedly accommodating corresponding ones of said plurality of socket contacts, a particular one of said plurality of conduits accommodating said particular socket contact and having a large size for containing said large active portion, a specified one of said plurality of conduits accommodating said specified socket contact and having a small size for containing said small active portion, each of said socket contacts having at least one lateral projection extending therefrom for serving as a stopper to prevent said specified socket contact from being accommodated in an incorrect one of said conduits, each of said conduits having at least one groove formed in said insulator housing, said groove extending in a lateral direction from each conduit and in a direction along each conduit, said at least one conduit accompanying each conduit receiving said at least one lateral projection of each socket contact accommodated in each conduit.

2. An electrical connector as claimed in claim 1, wherein said particular socket contact has one particular lateral projection , said large conduit accompanying said one groove having a particular lateral extension size for receiving said particular lateral projection, said specified socket contact having two lateral projections with a sufficient lateral projecting size exceeding a size accepted by said particular groove in order to prevent one of said specified lateral projections from being received in both said large conduit and said particular groove so that said specified socket contact is prevented from being accommodated within said large conduit.

3. An electrical connector as claimed in claim 1, wherein each one of said socket contacts has said at least one of lateral projection at a predetermined angular position which is different from a position of a lateral projection of another socket contact, the corresponding one of said each conduit having said at least one groove at a predetermined position to receive said each socket contact at a correct orientation.

* * * * *